United States Patent [19]

Ishiguro et al.

[11] 4,010,792

[45] Mar. 8, 1977

[54] METHOD FOR CONTINUOUSLY CASTING STEEL

[75] Inventors: Moriyuki Ishiguro; Shinobu Miyahara; Isao Sugawara; Masayuki Hanmyo; Shigetaka Uchida; Hideo Uchibori, all of Fukuyama; Shigeki Komori, Yokohama, all of Japan

[73] Assignee: Nippon Kokan Kabushiki Kaisha, Tokyo, Japan

[22] Filed: Oct. 30, 1975

[21] Appl. No.: 627,065

[30] Foreign Application Priority Data

Nov. 25, 1974 Japan ..... 49-134404

[52] U.S. Cl. ..... 164/76; 164/82

[51] Int. Cl.[2] ..... B22D 11/12

[58] Field of Search ..... 164/76, 82, 270, 282; 29/527.7; 72/234, 366

[56] References Cited

UNITED STATES PATENTS

| | | | |
|---|---|---|---|
| 3,491,824 | 1/1970 | Tarmann et al. | 164/82 X |
| 3,974,559 | 8/1976 | Kawawa et al. | 164/82 X |

*Primary Examiner*—Robert D. Baldwin

*Attorney, Agent, or Firm*—Flynn & Frishauf

[57] ABSTRACT

In continuously casting steel, at least two pairs of reduction rolls are arranged near the crater top where the solidification of the molten steel in the cast strand is completed, said reduction rolls having a roll pitch of 200 to 420mm and giving a draft per pair of 0.1 to 2.0%, and said cast strand is reduced near the to of said crater, whereby the inner quality of said cast strand is remarkably improved.

1 Claim, 5 Drawing Figures

METHOD FOR CONTINUOUSLY CASTING STEEL

FIELD OF THE INVENTION

The present invention relates to an improvement in the method for continuously casting steel.

BACKGROUND OF THE INVENTION

Continuous casting of steel has conventionally been carried out generally by a continuous casting machine either of the curved-mold or the straight-mold type. From among said two types, a continuous casting machine of the curved-mold type is shown in FIG. 1. As shown in FIG. 1, a molten steel 1 poured in a tundish 2 is teemed through a submerged nozzle 3 into a mold 4, where the molten steel is cooled to form a thin solidification shell 5. The molten steel having thus formed the solidification shell is withdrawn through a group of support rollers 6, a group of guide rollers 7, a group of reduction rolls 8 and a group of pinch rolls 13, arranged in this order below said mold 4. In the meantime, said solidification shell 5, cooled by cooling water sprayed from a number of nozzles 9 arranged between said rollers and rolls, has a gradually increasing thickness, whereas a part of steel still in the molten state 10 (hereinafter called "crater") has a gradually decreasing thickness, and finally the solidification of molten steel is completed. A continuously cast strand 11 having a prescribed crosssectional shape is formed by cooling said molten steel through the adjustment of the cooling rate, the withdrawal speed and other factors, so that the top of said crater 10 where the solidification of molten steel is completed may be in said group of reduction rolls.

However, in cast strands, whether cast by a continuous casting machine of the above-mentioned curved-mold type or of the straight-mold type, there often occur such inner defects as a center porosity (an assembly of fine shrinkage holes produced at the center of a cast strand), a center pipe (a center porosity growing up into a large pipe-shaped shrinkage hole) and a center segregation.

The above-mentioned inner defects in a cast strand are considered attributable to the following:

1. The solidification shell of a cast strand near the crater top mechanically bulges outward under the effect of the static pressure of molten steel at the crater top (the height from the molten steel surface in the mold to the crater top, multiplied by the density of molten steel), and steel still in molten state with condensated impurities and constituent elements is enclosed in this bulging, thus causing segregations.

2. Steel still in molten state with condensated impurities and constituent elements in the cast strand near the crater top is pulled by the part of steel having already solidified under the sucking effect occurring on the solidification and shrinkage. If, however, the transfer of this part of steel still in molten steel is insufficient, not only pores but also center segregations are formed in this part of the cast strand.

For the purpose of eliminating inner defects in a cast stand occurring from the aforementioned causes, a method has conventionally been proposed, for reducing a cast strand by at least 10% near the crater top through reduction rolls. This conventional method permits removal of center porosities and center segregations to some extent. According to this conventional method, however, the high draft such as at least 10% causes many inner cracks on the liquidus-solidus interface of the molten steel near the crater top. Furthermore, because of the steel still in molten state with condensated impurities and constituent elements penetrating into these inner cracks, the occurrence of segregations is still eradicable, and a satisfactory effect for the improvement of the inner quality of a cast strand has not as yet been obtained.

SUMMARY OF THE INVENTION

An object of the present invention is therefore to provide an improvement in the method for continuously casting steel, which permits drastic minimization of mechanical bulgings occurring in a cast strand.

In particular, an object of the present invention is to provide an improvement in the method for continuously casting steel, which permits prevention of the occurrence of inner defects of a cast strand such as center segregations, center porosities and inner cracks.

In accordance with one of the features of the present invention, there is provided an improvement in the method for continuously casting steel, which comprises arranging at least two parts of reduction rolls near the crater top in a cast strand, setting the roll pitch of said reduction rolls to about 200 to 420mm and setting the draft per pair of rolls to about 0.1 to 2.0%, and thus reducing said cast strand near the crater top.

DETAILED DESCRIPTION OF PREFERRED EMBODIMENTS

Figure 1:
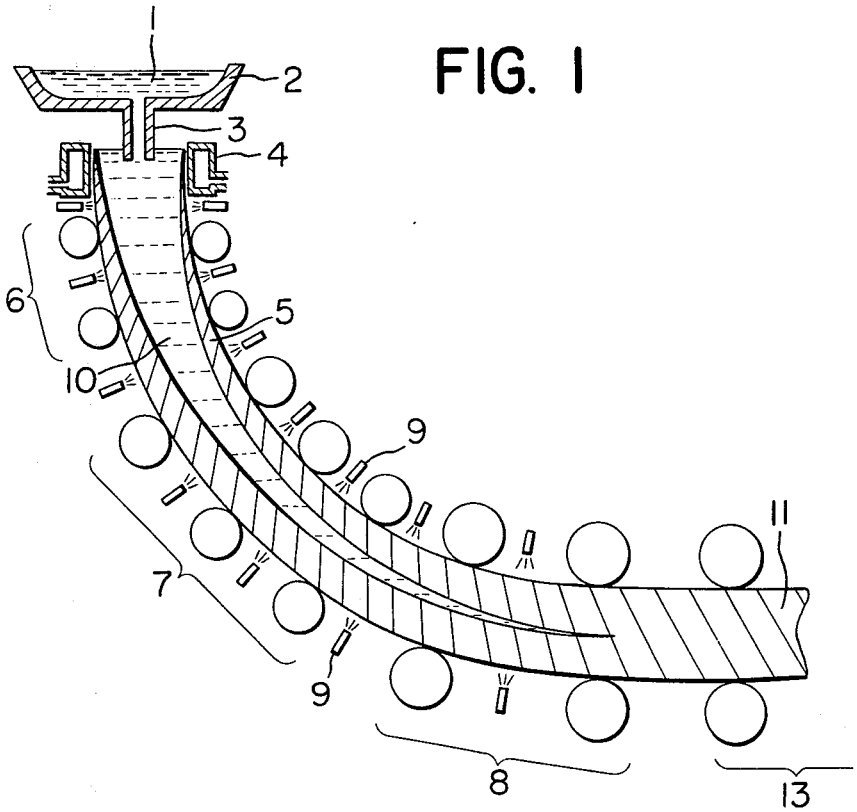
FIG. 1 is a schematic sectional view illustrating the continuous casting of steel by a curved-mold type continnous casting machine.
Figure 2:
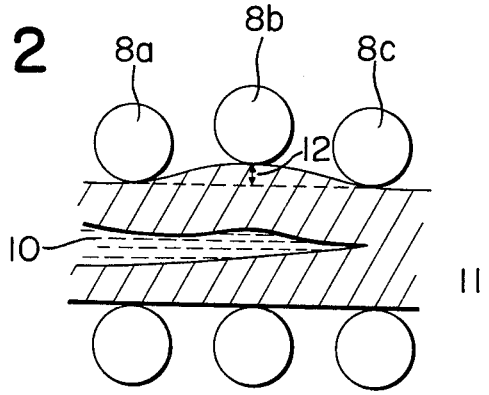
FIGS. 2 and 3 are schematic partially cutaway sectional views showing the formation of bulging of a cast strand.
Figure 3:
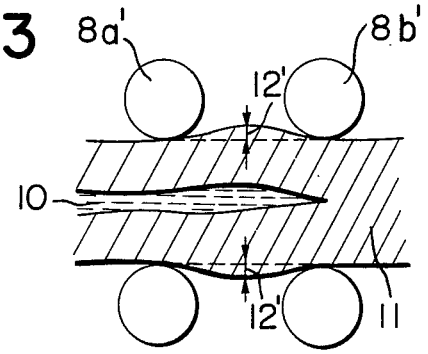

The aforementioned formation of a mechanical bulging cannot be prevented even by the application of a force larger than the static pressure of molten steel at the crater top to the reduction rolls as the roll pressing force. A bulging 12 caused in the case of reduction rolls 8*a*, 8*b* and 8*c* near the top of the crater 10 of a cast strand 11 with an insufficient roll alignment (centering of the roll pass line with a target track), as shown in FIG. 2, and a bulging 12′ formed between reduction rolls 8*a′* and 8*b′* near the top of the crater 10 of a cast strand 11, as shown in FIG. 3, for example, cannot be prevented even by increasing the rolling force of these reduction rolls over the static pressure of molten steel at the crater top.

It is possible to prevent the above-mentioned formation of a bulging caused by an insufficient roll alignment by applying a closer periodic inspection of the roll alignment of the continuous casting machine and a more strict checkup of strategic points before and after operation. A bulging between rolls, as mentioned above, inevitably occurs, however closely the roll alignment is adjusted, since the cast strand is bit between the reduction rolls arranged at a certain roll pitch.

In general, the amount of said bulging $\delta$ between rolls is expressed by the following formula for the calculation of an amount of elastic deflection of a beam:

$$\delta = k \times (P \cdot R^4)/(E \cdot d^3)$$

where,

*k:* constant;

*P:* static pressure of molten steel at the crater top of a cast strand;

*R:* roll pitch;

*E:* elastic modulus of the solidification shell of the cast strand near said crater top;

*d:* thickness of said solidification shell.

The above-mentioned formula suggests that, when the elastic modulus of the solidification shell E, the thickness *d* thereof and the static pressure of molten steel P are kept constant, a larger roll pitch R leads to a considerably increased amount of bulging δ between rolls. It is therefore possible to reduce the amount of bulging δ between rolls by decreasing the roll pitch R, thus largely improving the inner quality of the produced cast strand.

The above-mentioned formula is however only a mathematical model for conveniently representing the amount of bulging between rolls, not a functional equation directly related to the inner quality of a cast strand. It is therefore impossible, by the above-mentioned formula, to acquire accurate information as to how far the inner quality of a cast strand is improved by a particular change in the roll pitch.

In view of the foregoing, the inventors have long studied how to produce by a continuous casting a sound cast strand, having prescribed dimensions, free from such inner defects as a center porosity, a center pipe and a center segregation tending to occur near the crater top of a cast strand. The results have proved that a cast strand almot free from such inner defects as mentioned above is obtainable by arranging at least two pairs of reduction rolls near the crater top of the cast strand, said reduction rolls having a roll pitch of 200 to 420mm and giving a draft per pair of 0.1 to 2.0%, and by reducing said cast strand near the crater top.

In the method for continuously casting steel of the present invention, the reasons for the limitation of the reduction roll pitch and the draft per pair of said reduction rolls to values mentioned above are described below with reference to the following experiments.

By employing a model experimental continuous casting machine of the curved-mold type and under the following conditions:

1. Cast strand size: 150 × 500mm
2. Steel grade: 41 kg/mm$^2$ class steel for thick plate
3. Casting temperature of molten steel: 1,540° to 1,550° C
4. Static pressure of molten steel: 8 kg/cm$^2$, steel was continuously cast, while the minimum roll pitch of two pairs of reduction rolls, initially set at 100mm, was expanded in succession at intervals of 50mm up to a maximum roll pitch of 500mm. For each of said roll pitches, the draft per pair of said reduction rolls was varied in succession from 0 to 0.1, 0.2, 0.5, 0.8, 1.0, 1.6, 2.0 and 3.0%.

Test pieces were sampled from each of the cast strands thus obtained, and the presence of sulphur segregation and center porosities was measured as indexes of inner defects of cast strand (i.e., as inner quality indexes). The value of sulphur segregation was indicated by the percentage of the sulphur segregation line length calculated in accordance with the following formula (hereinafter called the "segregation length ratio"):

$$\frac{\text{Total length of sulphur segregation lines}}{\text{Length of measuring section}} \times 100\ (\%).$$

The state of formation of center porosities was based on the visual observation. In evaluating, the best segregation length ratio of 20% obtained by the conventional continuous casting method was deemed to be normal, values lower than 20% being judged to be good, and those higher than 20%, to be poor. With regard to the occurrence of center porosities, the minimum occurrence of center porosities so far obtained by the conventional continuous casting method was assumed to be normal, a state with less center porosities being regarded as good, and one with more center porosities, as poor.

Figure 4:
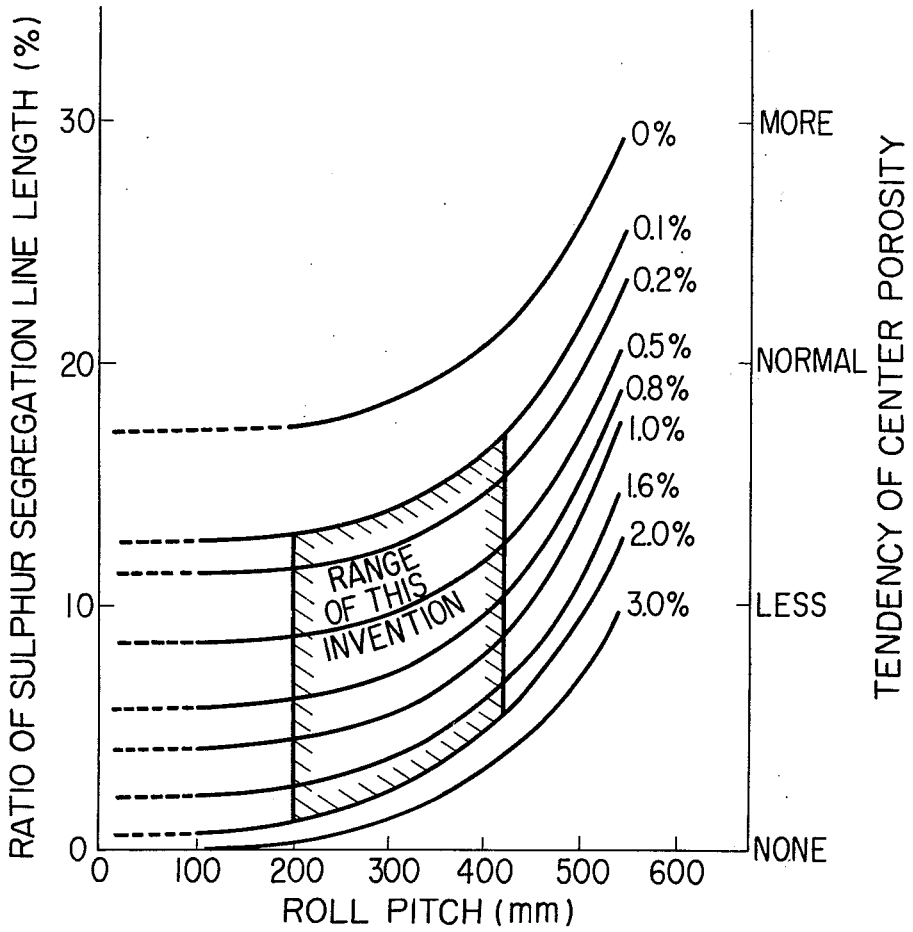
FIGS. 4 and 5 give curves representing the effect of the roll pitch and the draft on the inner quality index for strands cast, respectively, by a curved-mold type and a straight-mold type continuous casting machines.

The results of measurement thus obtained are given in FIG. 4 in relation to said roll pitch and said draft. In FIG. 4, the segregation length ratio of 20% and the normal state of occurrence of center porosities are indicated in correspondence to each other. As is clear from this figure, a smaller roll pitch leads to a more improved inner quality of cast strand at any draft, and the improvement is more remarkable at a larger draft. More specifically, accordingly as the draft per pair of the reduction rolls is increased and the roll pitch of the reduction rolls is decreased, the segregation length ratio as an inner quality index of cast strand becomes smaller, and the number of center porosities, also as an inner quality index, decreases at a rate similar to that of the segregation length ratio.

Furthermore, with regard to the roll pitch, as shown in FIG. 4, the reduction of the roll pitch to under 200mm brings about no remarkable improvement in the inner quality of cast strand. What is worse, the roll pitch, if reduced to under 200mm, makes it difficult to make a proper roll alignment and requires much labor for the maintenance of the reduction rolls, thus resulting in a more complicated equipment and a higher construction cost. For these reasons, a lower limit of roll pitch of 200mm is proposed in the present invention. As shown in the same drawing, a roll pitch exceeding 420mm results in a sudden worsening of the inner quality of the cast strand at any draft, and this is why an upper limit of roll pitch of 420mm is adopted in the present invention.

A draft of over 2.0%, if applied to a cast strand, causes many inner cracks on the liduidus-solidus interface of the molten steel near the crater top of the cast strand, and deteriorates the inner quality of cast strand. The upper limit of the draft per pair of the reduction rolls in the present invention is therefore set at 2.0%. At a roll draft of under 0.1%, both the segregation length ratio and the number of center porosities approach to the normal state of evaluation, and a remarkable improvement is not any more observed in the inner quality of cast strand. Moreover, the draft, if reduced to under 0.1%, leads to a very complicated equipment requiring a higher construction cost, and makes it difficult to make a proper roll alignment. For these reasons, a lower limit of draft per pair of the reduction rolls of 0.1% is adopted in the present invention.

Next, by employing a model experimental continuous casting machine of the straight-mold type and under the following conditions:

1. Cast strand size: 150 × 500mm
2. Steel grade: 41 kg/mm² class steel for thick plate
3. Casting temperature of molten steel: 1,540° to 1,550° C
4. Static pressure of molten steel: 12 kg/cm², steel was continuously cast by changing the roll pitch and the draft under the same conditions as those in the above-mentioned case with a model experimental continuous casting machine of the curved-mold type.

Test pieces were sampled from each of the cast strands thus obtained, and the segregation length ratio and the occurrence of center porosities were measured in the same manner as in the case of said curved-mold type model experimental machine. The results of said measurement are shown in FIG. 5 in relation to the roll pitch and the draft.

Figure 5:
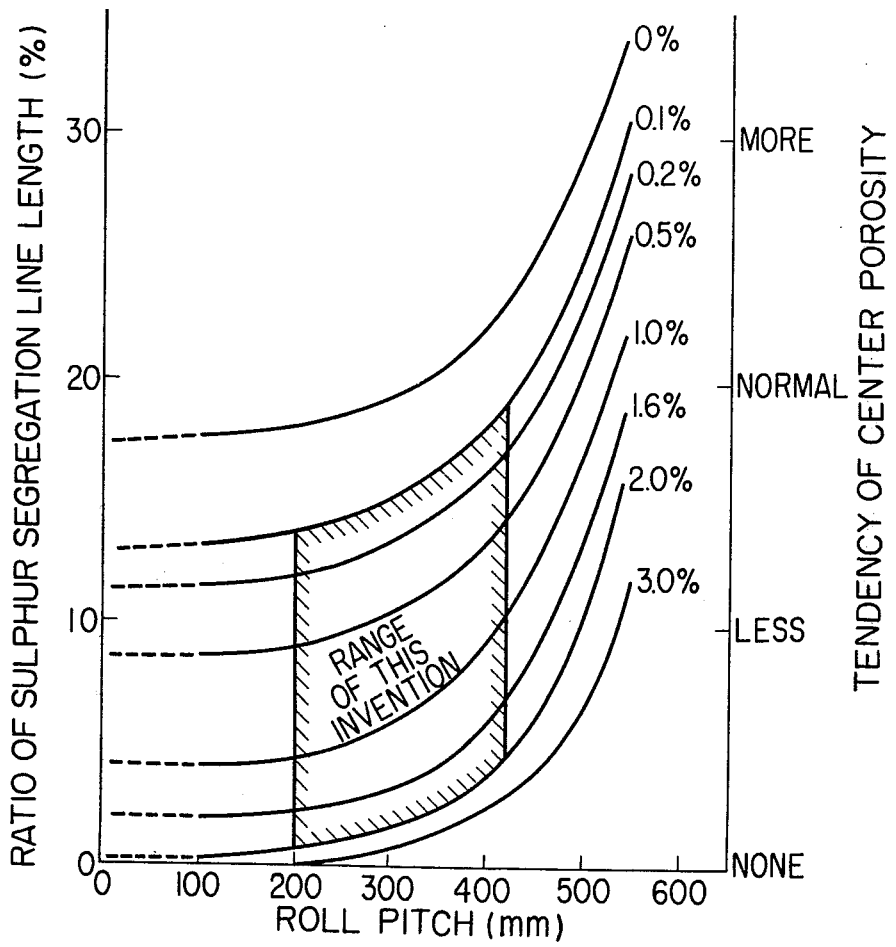

As shown in this drawing, FIG. 5 gives results almost identical with those given in FIG. 4. This proves that, even in the continuous casting of steel by a straight-mold type machine, the inner quality of cast strand can be remarkably improved, as in the case with a curved-mold type machine, by setting:

A roll pitch of the reduction rolls of 200 to 420mm; and

A draft per pair of the reduction rolls of 0.1 to 2.0%.

Continuous casting of steel at a normal casting temperature of molten steel has been described in the above-mentioned two examples of experiment. In the case of a low casting temperature, the growth of crystals not only from the surface caused by cooling of the cast strand surface, but also in the interior of the cast strand. Because of the tendency of dispersion of segregations resulting therefrom, it is difficult to express the sulphur segregation in terms of the segregation length ratio as described above. Center porosities, however, show results of measurement identical with those shown in FIGS. 4 and 5.

The present invention is further described with reference to an example in which an industrial continuous casting machine was employed.

EXAMPLE

An industrial two-strand curved-mold type continuous casting machine was used. The reduction rolls for strand A were arranged at a roll pitch of 260mm within the scope of the present invention over a distance of about 3m at the reduction roll section, and on the other hand, the reduction rolls for strand B were arranged at a roll pitch of 540mm outside the scope of the present invention. The draft per pair of the reduction rolls for said strand A was set at 0.3% within the scope of the present invention, and that for said strand B, 0.6% within the scope of the present invention. Steel was continuously cast under the following conditions:

1. Cast strand size: 250 × 1,900mm
2. Steel grade: 41 kg/mm² class steel for thick plate
3. Casting temperature of molten steel: 1,540° to 1,550° C
4. Static pressure of molten steel: 8 kg/cm²
5. Casting speed of molten steel: 0.6 to 0.7 m/min.

For each of the cast strands thus produced on said strands A and B, the segregation length ratio and the number of porosities were measured, and the following results were obtained:

| Kind | Inner quality index | Segregation length ratio | Center porosity |
|---|---|---|---|
| Cast strand on strand A | | 11.0 | Good |
| Cast strand on strand B | | 18.5 | Normal |

As shown in this table, the cast strand on strand A produced in accordance with the method of the present invention showed a remarkably improved inner quality, with no center segregations nor inner cracks, and center porosities were almost non-existent, as compared with the cast strand on strand B produced by a method not within the scope of the present invention.

As described above in detail, it is possible, according to the method of the present invention, to minimize bulgings mechanically produced on a cast strand as well as to eliminate or considerably minimize such inner defects as center segregations, center porosities and inner cracks and also to produce sound cast strands of prescribed dimensions, thus providing industrially useful effects.

What is claimed is:

1. In a method for continuously casting steel, comprising:

arranging a group of at least two pairs of reduction rolls near the crater top of a cast strand such that the solidification of the molten steel in said cast strand is substantially completed in said group of reduction rolls, reducing said cast strand near said crater top by said reduction rolls, setting the roll pitch of said reduction rolls to about 200mm to 420mm, and concurrently setting the draft per pair of said reduction rolls to about 0.1% to 2.0% to produce a cast strand with substantially no center segregations or inner cracks.

* * * * *